US005410764A

United States Patent [19]

Darnell

[11] Patent Number: 5,410,764

[45] **Date of Patent: * May 2, 1995**

[54] TILTABLE BATHTUB DEVICE

[76] Inventor: Clete Darnell, 5210 Kentucky Dam Rd., Paducah, Ky. 42003

[ * ] Notice: The portion of the term of this patent subsequent to Feb. 2, 2011 has been disclaimed.

[21] Appl. No.: 800,021

[22] Filed: Nov. 29, 1991

[51] Int. Cl.[6] ..... A47K 3/022
[52] U.S. Cl. ..... 4/540
[58] Field of Search ..... 4/540

[56] References Cited

U.S. PATENT DOCUMENTS

| | | | |
|---|---|---|---|
| 3,621,494 | 11/1971 | Bucher | 4/540 X |
| 4,099,273 | 7/1978 | Colby | 4/540 |
| 4,280,234 | 7/1981 | Sax | 4/540 |
| 4,592,099 | 6/1986 | Zellner | 4/540 |

*Primary Examiner*—Charles E. Phillips
*Attorney, Agent, or Firm*—Gilliam & Stockwell

[57] ABSTRACT

A bathtub which, when installed in a bathroom, is selectively tiltable between a horizontal position and a tilted position for ease in getting into and out of the bathtub. The tiltable bathtub can be positioned in a conventional bathtub bay of a bathroom without significant modification to the bathtub bay.

5 Claims, 3 Drawing Sheets

TILTABLE BATHTUB DEVICE

BACKGROUND OF THE INVENTION

The present invention relates to bathtubs, and more particularly to a tiltable bathtub which is selectively tilted between a horizontal position and a tilted position.

It is particularly difficult for physically-disadvantaged persons to take a bath in a conventional bathtub without help in getting into and out of the conventional bathtub. If physically-disadvantaged bathers were able to get into and out of a bathtub without assistance, it would not only save the time of someone who must help the bather, but would also afford the physically-disadvantaged bather privacy, and probably increase his/her feeling of self-esteem.

To the best of my knowledge, there are no such tiltable bathtubs.

SUMMARY OF THE INVENTION

The present invention provides a tiltable bathtub which is selectively tiltable between a horizontal position and a tilted position about a substantially horizontal pivot axis oriented substantially longitudinally of the bathtub.

The present invention also provides a tiltable bathtub of the above class which fits into a conventionally sized and shaped bathroom bathtub bay.

The present invention further provides a tiltable bathtub having a tilting control conveniently located for operation by a physically-disadvantaged bather.

More particularly, the present invention provides a tiltable bathtub device comprising a bathtub having two spaced-apart interior transverse end walls, an interior longitudinal front side wall, an interior longitudinal back side wall spaced from the front side wall, and a floor; pivot mounting means structurally associated with the bathtub for allowing pivotal movement of the bathtub about a generally horizontal longitudinal axis of the bathtub between a horizontal position and a tilted position; and means for selectively pivoting the bathtub about the pivot axis between the horizontal and tilted positions.

BRIEF DESCRIPTION OF THE DRAWINGS

A better understanding of the present invention will be had upon reference to the following discussion in conjunction with the accompanying drawings, wherein like numerals refer to like parts throughout the views and in which.

DETAILED DESCRIPTION OF THE PREFERRED EMBODIMENT

Figure 3:
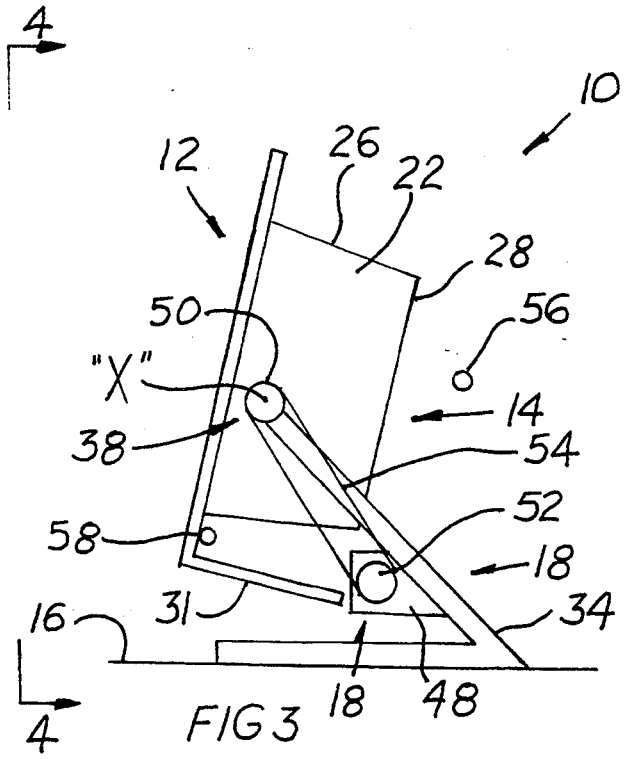
FIG. 3 is an end view of the tiltable bathtub device of FIG. 1 in a tilted position.
Figure 4:
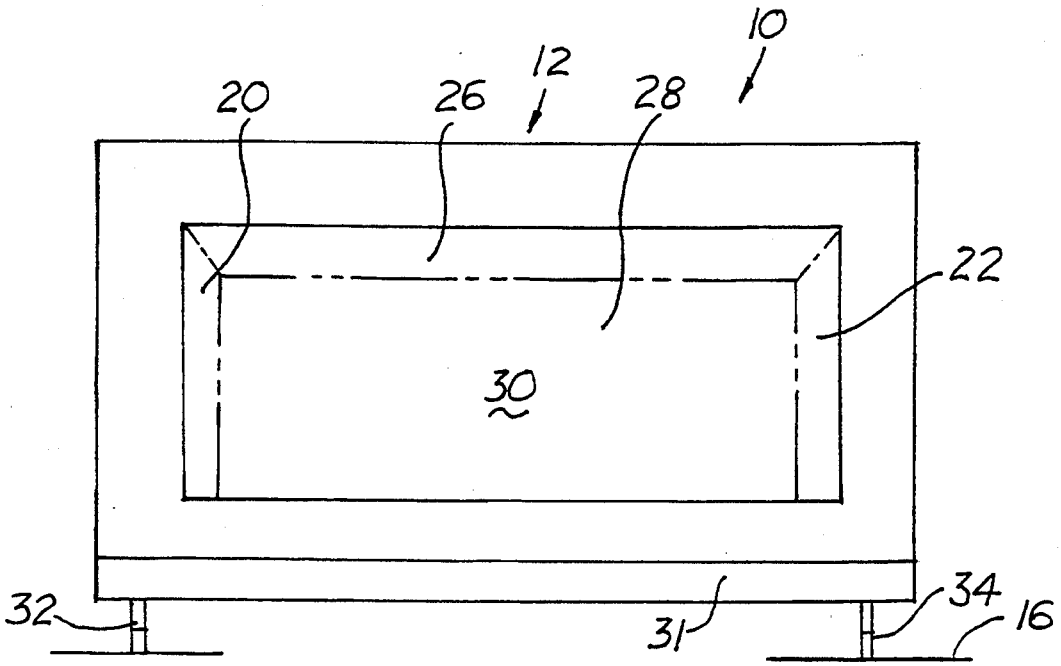
FIG. 4 is a longitudinal side view of the tiltable bathtub device as seen in the direction of arrows 4—4 in FIG. 3.

With reference to FIGS. 1–4, there is shown a tiltable bathtub device, generally denoted as the numeral 10, for selective pivotal movement about a generally horizontal and longitudinal axis "X" between a horizontal position (FIGS. 1 and 2) and a tilted position (FIGS. 3 and 4).

The bathtub device 10 comprises a bathtub 12, pivot mounting means 14 structurally associated with the bathtub 12 for supporting the bathtub above the floor 16 of a bathroom and for the pivotal movement of the bathtub 12 about the pivot axis "X", and means 18 for selectively pivoting the bathtub 12 about the pivot axis "X".

The bathtub 12 can be of substantially conventional design and includes two spaced-apart interior transverse end walls 20 and 22, an interior longitudinal front side wall 24, an interior longitudinal back side wall 26 spaced from the front side wall 24, and a floor 28 cooperating to define a bathing enclosure 30. The bathtub 12 also includes a longitudinal front fascia panel 31 spaced in front of the interior front side wall 24 and depending from the top end of the front side wall 24.

Figure 1:
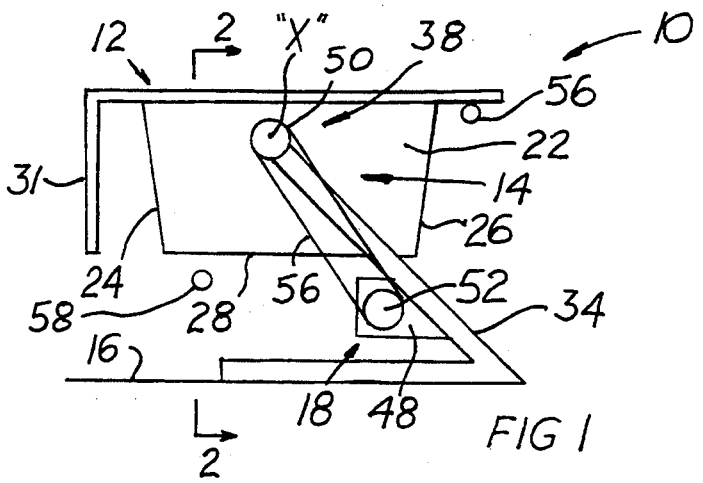
FIG. 1 is an end view of a tiltable bathtub device of the present invention, in the horizontal position.
Figure 2:
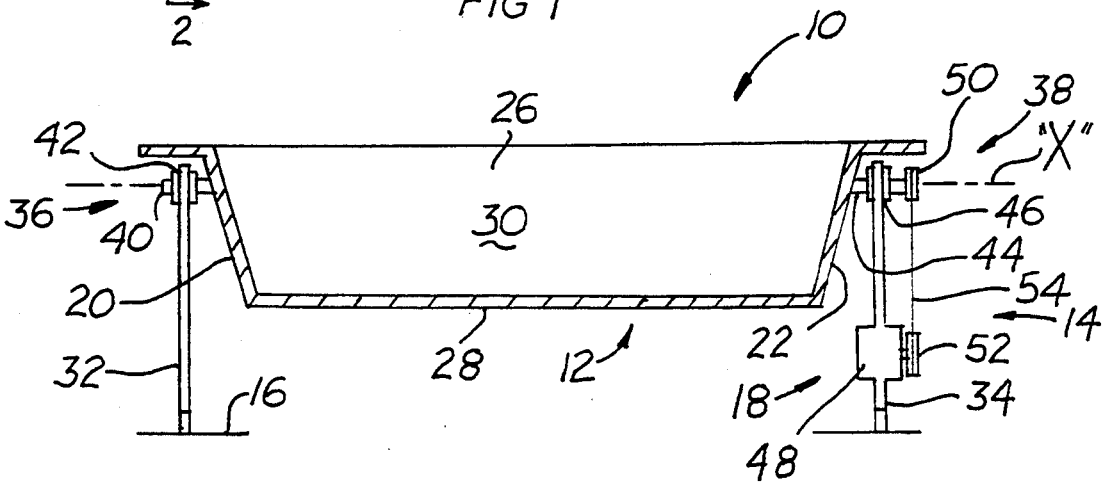
FIG. 2 is a longitudinal cross-sectional view of the tiltable bathtub device of the present invention as seen in the direction of arrows 2—2 in FIG. 1, in the horizontal position.

The pivot mounting means 14 includes stand means such as two spaced-apart stands 32 and 34 for supporting the bathtub 12 above the bathroom floor 16, first pivot means 36 attaching the stand 32 to the bathtub end wall 20, and second pivot means 38 attaching the stand 34 to the bathtub end wall 22. The first pivot means 36 comprises a first stub axle 40 mounted to and extending outwardly from the bathtub end wall 20 and a first journal 42 at the top end of the first stand 32 receiving the first stub axle 40. The second pivot means 38 comprises a second stub axle 44 mounted to and extending outwardly from the other bathtub end wall 22 and a second journal 46 at the top end of the second stand 34 receiving the second stub axle 44. The first stub axle 40 and second stub axle 44 are coaxial and define the pivot axis "X". As shown in FIGS. 1 and 3, the stub axles 40, 44 are parallel to the longitudinal centerline of the bathtub 12 and are off-set from the bathtub longitudinal centerline toward the interior first side wall 24.

The means 18 for selectively pivoting the bathtub 12 about the axis "X" can be of various conventional or otherwise convenient designs. However, with reference to FIGS. 1–3, the selectively pivoting means 18 comprises a sealed electric motor 48 mounted to, for example, the stand 34, a driven chain sprocket 50 concentrically mounted on the second stub axle 44, a driving chain sprocket 52 mounted on the output shaft of the motor 48, and a drive chain 54 trained about the driven chain sprocket 50 and driving chain sprocket 52. The electric motor 48 can be activated by a reversing switch 86 conveniently located outside the bathtub 12. A first limit switch 56 is operatively associated with the electric motor 48, mounted to the stand 34 and located to be contacted by the bathtub 12 when in the horizontal position. A second limit switch 58 is operatively associated with the electric motor 48, mounted to the stand 34 and located to be contacted by the bathtub 12 when in the tilted position.

The means 18 for selectively pivoting the bathtub 12 can be operated to tilt the bathtub 12 through an angle of 90 Degrees or less. Preferably, the bathtub 12 is pivoted through an angle of approximately about 85 Degrees to lower the top end of the bathtub front side wall 24 to chair height, or about 20 inches above the bathroom floor 16. In the tilted position, the bathtub interior front side wall 24 is angled approximately 5 Degrees from the horizontal. These features of the present invention allow a physically-disadvantaged bather to easily get into and out of the tilted bathtub. For example, a bather in a wheelchair can move the wheelchair up to the front side of the bathtub, and activate the conveniently located switch 86 to activate the motor 48 to pivot the bathtub 12 from the horizontal position to the tilted position. When the bathtub 12 is in the forwardly tilted position, the top end of the interior front side wall 24 is at approximately the same height above the bathroom floor 16 as is the seat bottom of the wheelchair. The bather can then easily slide from the wheelchair seat and onto the now generally horizontal bathtub front side wall 24 in a seated position. Once seated on the generally horizontal bathtub front side wall 24, the bather can easily slide into a prone position, and activate the switch to activate the motor 48 to pivot the bathtub 12 back to the horizontal position in preparation to filling the bathtub 12 with water.

Figure 5:
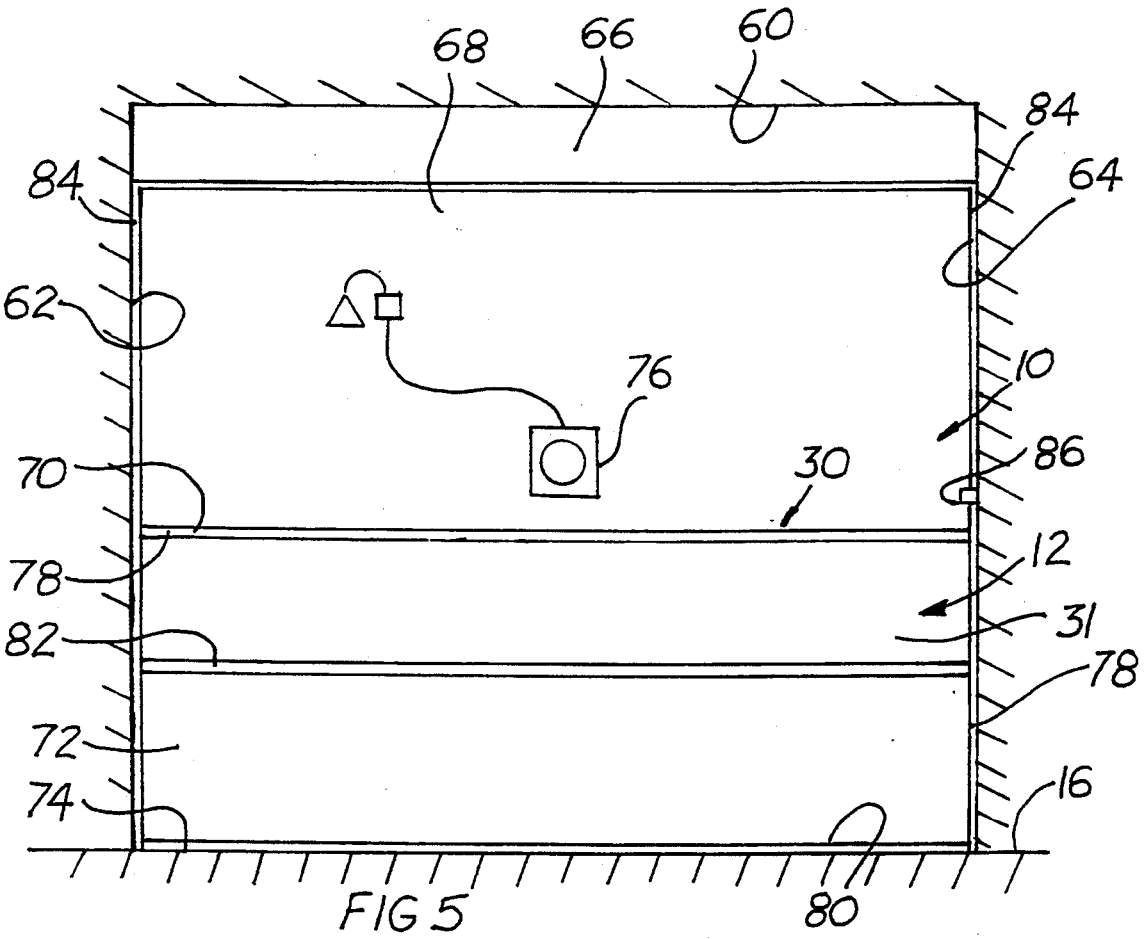
FIG. 5 is a front view of the tiltable bathtub installed in a bathroom bay with the bathtub in the horizontal position.
Figure 6:
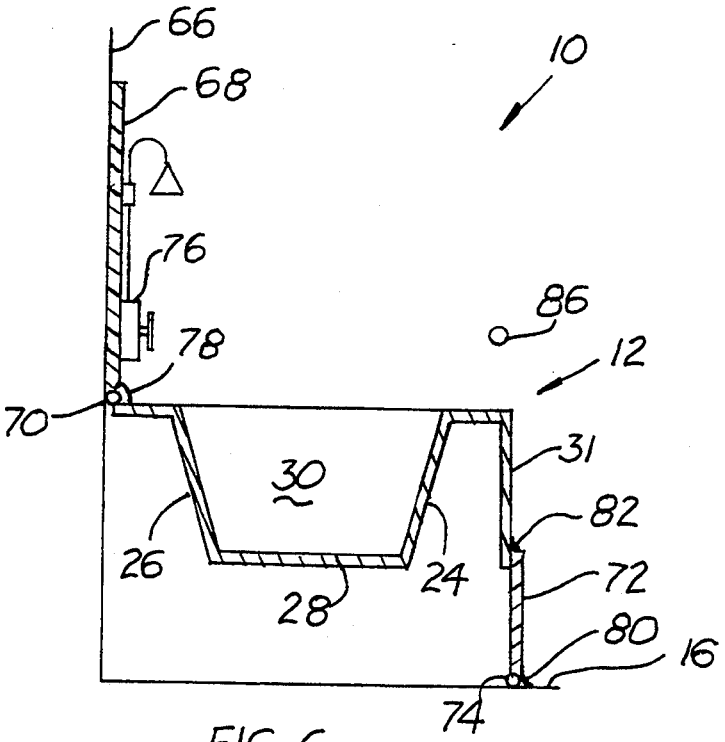
FIG. 6 is a transverse cross-sectional view of the bathtub installation of FIG. 5.
Figure 7:
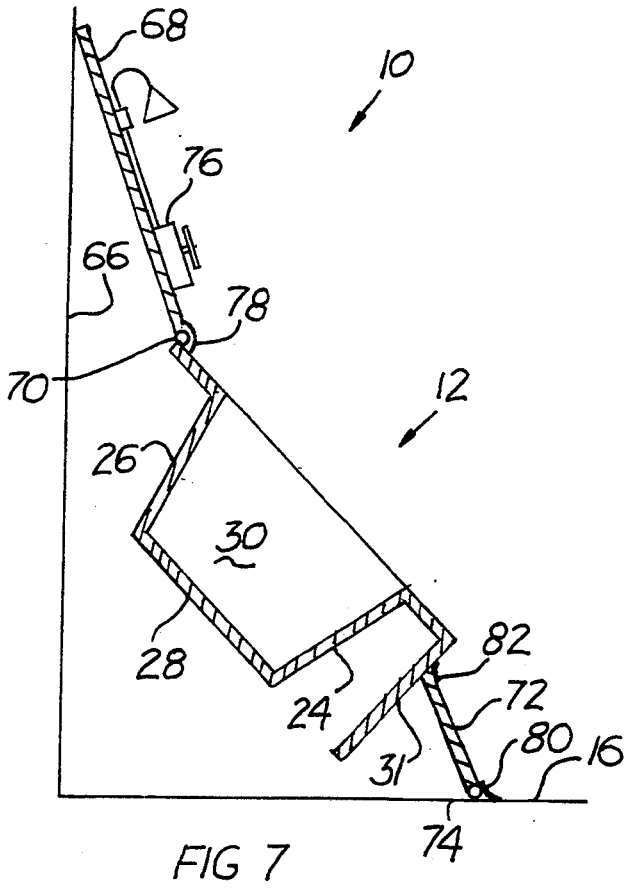
FIG. 7 is a transverse cross-sectional view of the bathtub installation, but with the bathtub in the tilted position.

FIGS. 5, 6, and 7 show the bathtub device 10 installed in a conventionally sized and shaped bathtub bay 60. Typical bathroom bathtub bays 60 have side walls 62 and 64 spaced apart by a distance approximately equal to the length of a bathtub 12, and a bay back wall 66 spanning the distance between the bay side walls 62, 64. The bay back wall 66 is spaced from the front opening of the bathroom bathtub bay 60 by a distance approximately equal to the width of the bathtub 12. The bathtub device 10 is installed inside the bathtub bay 60 with the length of the bathtub 12 extending between the bay side walls 62, 64 in the conventional manner.

With continued reference to FIGS. 5–7, the bathtub device 10 also comprises a bathtub bay back panel 68 projecting upwardly from the top end of the bathtub back side wall 26. The bottom edge of the bathtub bay back panel 68 is pivotally attached to the bathtub 12 along the intersection thereof with the top end of the bathtub back side wall 26 by a hinge 70. When the bathtub 12 is in the horizontal position (see FIGS. 5 and 6), the bay back panel 68 overlays the back wall 66 of the bathtub bay 60. When the bathtub 12 is in the tilted position (see FIG. 7), the bay back panel 68 will move with the bathtub 12 and pivot about the hinge 70 to assume an angle with the bay back wall 66 with the top edge of the bay back panel 68 riding along the bay back wall 66.

Still with reference to FIGS. 5–7, the bathtub device 10 further comprises a bathtub bay front panel 72 extending along the front fascia panel 31 of the bathtub 12 and extending upwardly from the bathroom floor 16 in overlapping relationship to the exterior surface of the bathtub front fascia panel 31. The height of the bathtub bay front panel 72 is less than the height of the front fascia panel 31 measured from the bathroom floor 16. The bathtub bay front panel 72 is pivotally attached to the bathroom floor 16 along its bottom edge by a hinge 74. When the bathtub 12 is in the horizontal position (see FIG. 6), the bay front panel 72 overlays a portion of the height of the bathtub front fascia panel 31. When the bathtub 12 is in the tilted position (see FIG. 7), the bathtub bay front panel 72 pivots about the hinge 74 to assume an angle with the bathroom floor 16 with the top edge of the bathtub bay front panel 72 remaining in contact with the bathtub fascia panel 31.

A water valve is located in a small valve pocket structure 76 formed in the bay back panel 68 open to the back side of the bay back panel 68, and with a water valve control handle projecting from the front side of the pocket structure 76. The valve pocket structure 76 is located just above the bathtub 12 and is longitudinal centered along the length of the bathtub 12. A flexible water conduit connects the water valve to a source of water. The water drain in the bathtub 12 is connected by another flexible conduit to a floor drain.

The bathtub 12 includes a peripheral seal 78 to seal against the bay side walls 62, 64, and along the intersection of the bay back panel 68 and bathtub 12 along the hinge 70 to prevent water from leaking therepast. A peripheral seal 80 extends along the intersection of the bay front panel 72 and bathroom floor 16 along the hinge 74, extends along the top edge of the bay front panel 72 in contact with the bathtub front fascia panel 31, and along each end of the bay front panel 72 at the intersection thereof with the bathtub bay side walls 62, 64 to prevent water from leaking therepast. In addition, seals 84 extend along the end edges of the back wall panel 68 at the intersection thereof with the bathtub bay side walls 62, 64 to prevent water from leaking therepast.

As can be seen in FIGS. 5, 6, and 7, the motor control switch 86 is located on, for example, the bathtub bay side wall 62 near the front opening into the bathtub bay 60 at a height easily reachable by, for example, a bather seated in a wheelchair.

The present invention provides a bathtub device 10 which can be installed in a conventionally sized and shaped bathtub bay 60 and, therefore, the present invention can be installed in an existing bathroom without extensive modification to the bathroom bay 60.

In addition, the bathtub device 10 provides a neat appearance.

Even further, the bathtub device 10 also provides an installation which prevents water from leaking therepast.

The foregoing detailed description is given primarily for clearness of understanding and no unnecessary limitations are to be understood therefrom for modifications will become obvious to those skilled in the art and may be made without departing from the spirit of the invention and scope of the appended claims.

I claim:

1. A tiltable bathtub device comprising:

a. a bathtub having two spaced-apart interior end walls each having top end, an interior front side wall having a top end, an interior back side wall having a top end spaced from the interior front side wall, and a floor;

b. pivot mounting means structurally associated with the bathtub for supporting the bathtub above a floor of a bathroom and for the pivotal movement of the bathtub about a generally longitudinal axis of the bathtub between a horizontal position and a tilted position;

c. means for selectively pivoting the bathtub about the pivot axis;

d. a bathtub bay back panel having a bottom edge in juxtaposition to the top end of the bathtub back side wall, and projecting upwardly from the top end of the bathtub back side wall in overlaying relationship to a bathroom wall adjacent the interior back side wall of the bathtub, and, e. pivot means pivotally attaching the bottom edge of the bathtub bay back panel to the top end of the bathtub interior back side wall.

2. The tiltable bathtub device of claim 1, further comprising a seal extending along the interface of the bottom edge of the bathtub bay back panel and the top end of the bathtub back side wall.

3. The tiltable bathtub device of claim 1, wherein the bathtub bay back panel further comprises a peripheral seal.

4. A tiltable bathtub device comprising:

a. a bathtub having two spaced-apart interior end walls, an interior front sidewall, an interior back sidewall spaced from the interior front sidewall, and a floor;

b. pivot mounting means structurally associated with the bathtub for supporting the bathtub above a floor of a bathroom;

c. means for selectively pivoting the bathtub about the pivot axis;

d. a depending a front facia panel extending along and spaced outwardly from the bathtub interior front sidewall, the front facia panel having an interior surface facing the bathtub interior front sidewall and an opposite exterior surface;

e. a bathtub bay front panel having a bottom edge and extending along the bathtub front facia panel and projecting upwardly from the floor of the bathroom in overlapping relationship to the exterior surface of the front facia panel of the bathtub; and, f. pivot means pivotally attaching the bottom edge of the bathtub bay front panel to the floor of the bathroom.

5. The tiltable bathtub device of claim 4, wherein the bathtub bay front panel further comprises a peripheral seal.

* * * * *